US007777688B2

(12) United States Patent
Tani et al.

(10) Patent No.: US 7,777,688 B2
(45) Date of Patent: Aug. 17, 2010

(54) POLARIZATION SWITCHING ANTENNA DEVICE

(75) Inventors: Kazuya Tani, Osaka (JP); Yoshio Koyanagi, Kanagawa (JP); Hiroshi Haruki, Kanagawa (JP)

(73) Assignee: Panasonic Corporation, Osaka (JP)

( * ) Notice: Subject to any disclaimer, the term of this patent is extended or adjusted under 35 U.S.C. 154(b) by 498 days.

(21) Appl. No.: 11/721,566

(22) PCT Filed: Aug. 16, 2005

(86) PCT No.: PCT/JP2005/014947

§ 371 (c)(1),
(2), (4) Date: Jun. 13, 2007

(87) PCT Pub. No.: WO2006/064590

PCT Pub. Date: Jun. 22, 2006

(65) Prior Publication Data

US 2009/0251383 A1 Oct. 8, 2009

(30) Foreign Application Priority Data

Dec. 16, 2004 (JP) ..... 2004-363844

(51) Int. Cl.
*H01Q 1/50* (2006.01)

(52) U.S. Cl. ..... 343/852

(58) Field of Classification Search ..... 343/753, 343/702, 745, 737, 852
See application file for complete search history.

(56) References Cited

U.S. PATENT DOCUMENTS

| | | | | |
|---|---|---|---|---|
| 6,759,991 | B2 * | 7/2004 | Boyle | 343/702 |
| 7,038,631 | B2 * | 5/2006 | Jecko et al. | 343/767 |
| 7,106,259 | B2 * | 9/2006 | Tseng et al. | 343/702 |
| 7,443,344 | B2 * | 10/2008 | Boyle | 343/700 MS |

FOREIGN PATENT DOCUMENTS

| | | |
|---|---|---|
| JP | 08-154012 | 6/1996 |
| JP | 11-088246 | 3/1999 |
| JP | 2000-077934 | 3/2000 |
| JP | 2001-326514 | 11/2001 |
| JP | 2001-332930 | 11/2001 |
| JP | 2003-158468 | 5/2003 |
| JP | 2004-140815 | 5/2004 |
| WO | 03/094290 | 11/2003 |

* cited by examiner

*Primary Examiner*—Huedung Mancuso
(74) *Attorney, Agent, or Firm*—Pearne & Gordon LLP

(57) ABSTRACT

A polarization switching antenna device capable of switching a polarization without increase of an antenna installing space and also handling a variety of frequency bands is provided. A connection state of one end of a loop antenna element arranged on a side surface of a case is switched. Thus, the polarization characteristic is switched by switching selectively whether the antenna element should constitute a loop antenna or a linear antenna. Matching circuits suitable for respective characteristics are provided. The loop antenna can be fed in terms of a balanced feeding. A balanced feeding and an unbalanced feeding can be switched.

9 Claims, 9 Drawing Sheets

POLARIZATION SWITCHING ANTENNA DEVICE

TECHNICAL FIELD

The present invention relates to a polarization switching antenna device that can be installed into a mobile radio apparatus.

BACKGROUND ART

In the radio communication, commonly the user can hold communication with the person on the other end under optimal conditions by using the antenna having the same polarization characteristic mutually. Also, if plural types of polarizations such as vertical polarization, horizontal polarization, circular polarization, and the like, for example, are used selectively as occasion demands, either a reduction in interference with other communications or an improvement in receiving sensitivity can be achieved in a variety of environments.

As the technology of the antenna unit capable of using plural types of polarizations selectively in the prior art, for example, the technologies set forth in Patent Literature 1, Patent Literature 2, and Patent Literature 3 have been known.

In Patent Literature 1, it has been proposed that a monopole antenna and a loop wire having two parallel straight portions are provided to the ground plane and then linear polarization, clockwise circular polarization, and counter clockwise circular polarization are used selectively without change of a direction or a configuration of the antenna by operating a polarization changing switch provided between them.

In Patent Literature 2, it has been proposed that a plurality of loop antennas arranged along mutually different case surfaces of the receiver unit respectively and a switching means for selecting the receiving signal are provided and then high receiving performance can be ensured by selecting the antenna that is effective in the directivity and the plane of polarization.

In Patent Literature 3, it has been proposed that a polarization diversity reception is carried out by providing a monopole antenna, which receives one of two radio waves having a different plane of polarization mutually, to the inside of a loop antenna, which receives the other of two radio waves.

Patent Literature 1: JP-A-2000-77934
Patent Literature 2: JP-A-11-88246
Patent Literature 3: JP-A-2001-332930

DISCLOSURE OF THE INVENTION

Problems that the Invention is to Solve

The above polarization switching antenna device in the prior art depends on the assumption that a plurality of antenna elements having a different receiving polarization mutually are installed. In this event, the case where a plurality of antenna elements are installed needs twice or more an installing space of the case where a single antenna element is installed, and also wires used for connection of the antenna elements are increased. However, since a higher performance and a space saving are big themes in the state-of-the-art mobile communication terminal, it is difficult to increase the antenna installing space.

Also, since the communication services have diversified in this day, such a necessity arises that a variety of radio waves whose frequency bands used mutually are largely different and whose main polarizations used are different between the terrestrial digital broadcasting and the cellular phone, for example, should be received by one mobile communication terminal. However, in the prior art, a plurality of independent antenna elements must be installed to receive a plurality of radio waves whose frequency bands are largely different.

It is an object of the present invention to provide a polarization switching antenna device capable of switching a polarization without increase of an antenna installing space and also handling a variety of frequency bands.

Means for Solving the Problems

A polarization switching antenna device of the present invention applied to a radio apparatus, includes an antenna element that is constituted by a conductor shaped into a loop, and has a first end portion adapted to be connected to a first feeding point of the radio apparatus or a ground point and a second end portion adapted to be connected to a second feeding point of the radio apparatus or the ground point; and a switch that is provided to at least one of the first end portion and the second end portion to open the antenna element from an electronic circuit of the radio apparatus. A first antenna characteristic having a high sensitivity to a magnetic field and a second antenna characteristic having a high sensitivity to an electric field are switched by switching the switch.

In other words, since both ends of the conductor are connected to the feeding point or the ground point when the switch is closed, the conductor functions as the loop antenna having a high sensitivity to a magnetic field. Also, since only one end of the conductor is connected to the feeding point when the switch is opened, the conductor functions as the linear antenna having a high sensitivity to an electric field. As a result, an operation mode of a single antenna is changed by switching the switch and accordingly the polarization characteristic and the frequency characteristic of the antenna are also changed. Also, for example, when the conductor functions as the loop antenna, a high receiving sensitivity can be obtained even in a state that in close vicinity of the human body.

The polarization switching antenna device of the present invention further includes a first matching circuit for matching a circuit to the first antenna characteristic; a second matching circuit for matching a circuit to the second antenna characteristic; and a matching switching circuit for switching the first matching circuit and the second matching circuit. In this case, the first matching circuit, the second matching circuit, and the matching switching circuit are provided to an end portion, to which the switch is not provided, out of the first end portion and the second end portion. Further, the polarization switching antenna device of the present invention further includes a variable reactance element connected between the switch and the ground point to change an antenna resonance frequency of the antenna element.

When the antenna characteristic is changed by switching the switch, an impedance of the antenna is also changed. Therefore, the antenna and the receiver circuit can be connected under optimal conditions by employing independent matching circuits that are suitable for respective antenna characteristics. Also, since a resonance frequency of the antenna can be changed at need by connecting the variable reactance element to the antenna, the antenna characteristic can be suited to the receiving frequency band without change of a length of the conductor.

Also, the polarization switching antenna device of the present invention further includes a balance/unbalance transducer for transforming a balanced input into an unbalanced output; and a route switching portion for switching a first signal route passing through the balance/unbalance transducer and a second signal route not passing through the balance/unbalance transducer to feed the antenna. In this case, at least one of inputs of the balance/unbalance transducer is connected to the antenna element via the switch.

The loop antenna can be connected in terms of the balanced feeding by providing the balance/unbalance transducer. In the case of the balanced feeding, a current is hard to flow through the case of the radio apparatus and as a result the polarization characteristic of the antenna can be improved.

Also, the switch is provided in double to both the first end portion and the second end portion and both switches switch selectively a connection state so that a connection state of the antenna element is set to either of an unbalanced feeding and a balanced feeding. The polarization switching antenna device of the present invention further includes a balance/unbalance transducer connected to the antenna element via two switches to transform a balanced input into an unbalanced output; and a route switching portion for switching a first signal route passing through the balance/unbalance transducer and a second signal route not passing through the balance/unbalance transducer to feed the antenna.

A connection state of the antenna is switched to either of the unbalanced feeding and the balanced feeding by switching the switch and the route switching portion. A large change appears in the current flowing through the case of the radio apparatus by switching the feeding state of the loop antenna and as a result the antenna characteristic is changed.

For example, when the operating frequency is different mutually, the vertical polarization can be obtained by constructing the loop antenna of the unbalanced feeding as the infinitesimal loop antenna, and the horizontal polarization can be obtained by constructing the 1-wave loop antenna of the balanced feeding. Also, even when the same frequency band is utilized, the vertical polarization component of the antenna characteristic appears largely in the unbalanced feeding, so that this antenna unit can receive both the vertical polarization and the horizontal polarization.

The polarization switching antenna device of the present invention further includes an intermediate connection switch provided to an intermediate portion of the antenna element and connected to a third feeding point or a ground point; wherein the antenna element operates as an inverted F antenna by switching the intermediate connection switch in a state that the switch is opened.

Since the inverted F antenna is constructed as the antenna having the second antenna characteristic, the impedance matching and the frequency adjustment can be facilitated rather than the linear antenna.

The polarization switching antenna device of the present invention further includes a diversity selecting portion for selecting at least one of plural types of received signals that are received based on mutually different antenna characteristics and outputting the selected signal.

Even when the number of the used antenna elements is only one, the antenna characteristic can be switched to plural antenna characteristics having different polarizations in the present invention. Therefore, a receiving quantity can be improved if the antenna characteristic having the better receiving characteristic is selected appropriately. In other words, the polarization diversity can be realized. In this case, when only one antenna element is used, a receiving quantity must be checked by switching periodically the antenna characteristic, for example.

A radio apparatus including the above polarization switching antenna device is also contained in the present invention.

Advantages of the Invention

According to the present invention, a plurality of antenna characteristics each of which has a different polarization characteristic can be implemented by using a single antenna element. Therefore, the polarization can be switched without increase of an antenna installing space and also this antenna can handle a variety of frequency bands. Also, a receiving sensitivity can be improved by employing the polarization diversity reception.

DESCRIPTION OF REFERENCE NUMERALS

Figure 1:
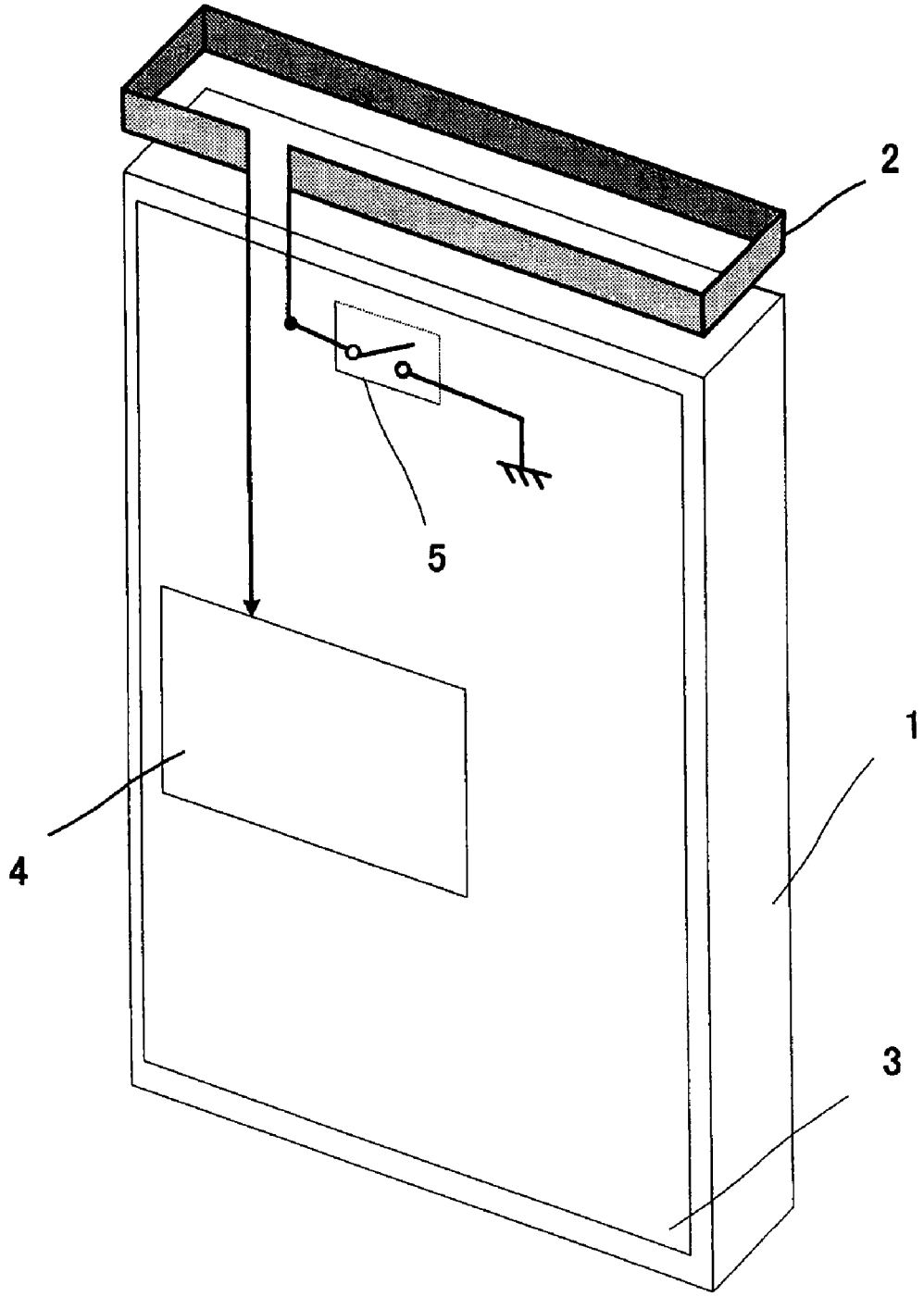
[FIG. 1] A block diagram showing a configuration of a polarization switching antenna device according to a first embodiment of the present invention in a state that such antenna unit is installed into a radio apparatus.

1 radio apparatus case
2 antenna element
3 circuit substrate
4 receiver circuit
5, 9, 12, 14, 15, 16, 17, 18, 19 switching circuit
6 variable reactance circuit
7, 8, 11, 13, 20 matching circuit
10 balance/unbalance transducer circuit
21 diversity switching circuit

BEST MODE FOR CARRYING OUT THE INVENTION

First Embodiment

A first embodiment of polarization switching antenna device according to the present invention will be explained with reference to FIG. 1 to FIG. 4 hereinafter.

Figure 2:
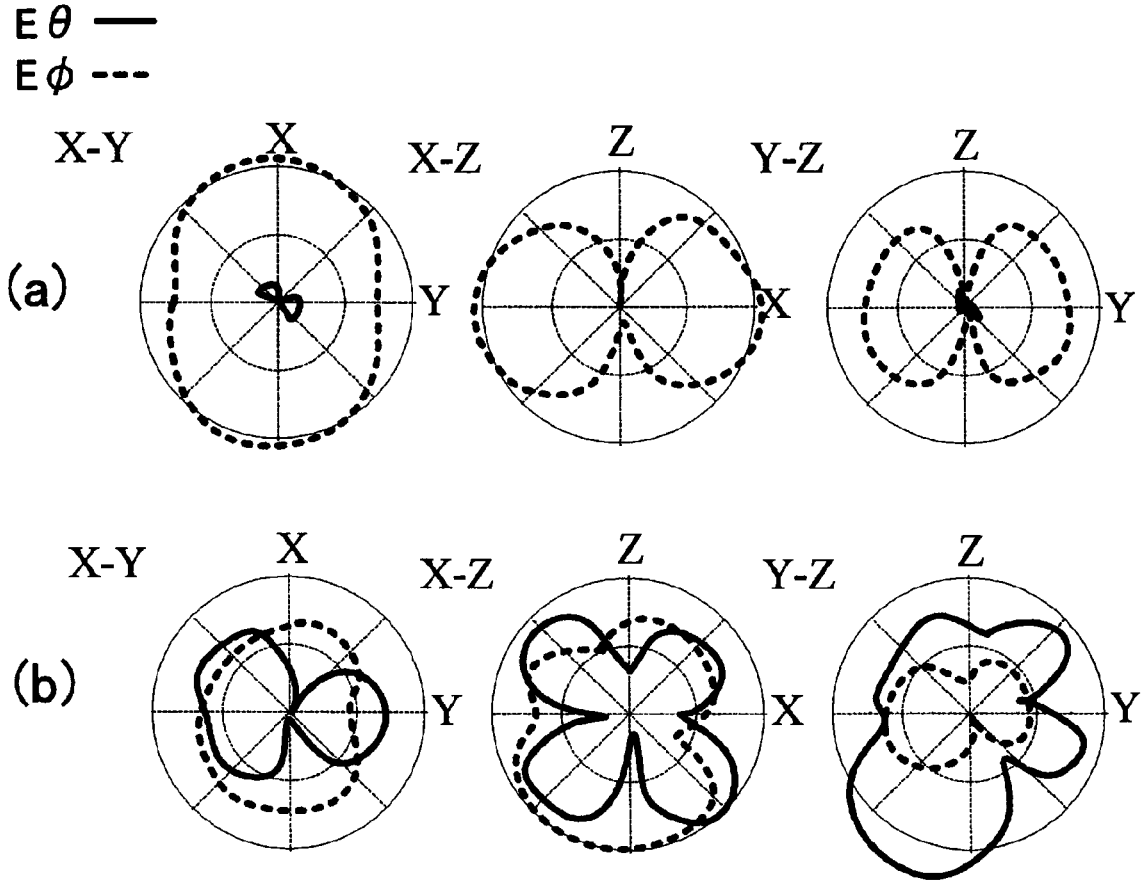
[FIG. 2] Radiation pattern charts showing the result of a simulation done in the first embodiment.
Figure 3:
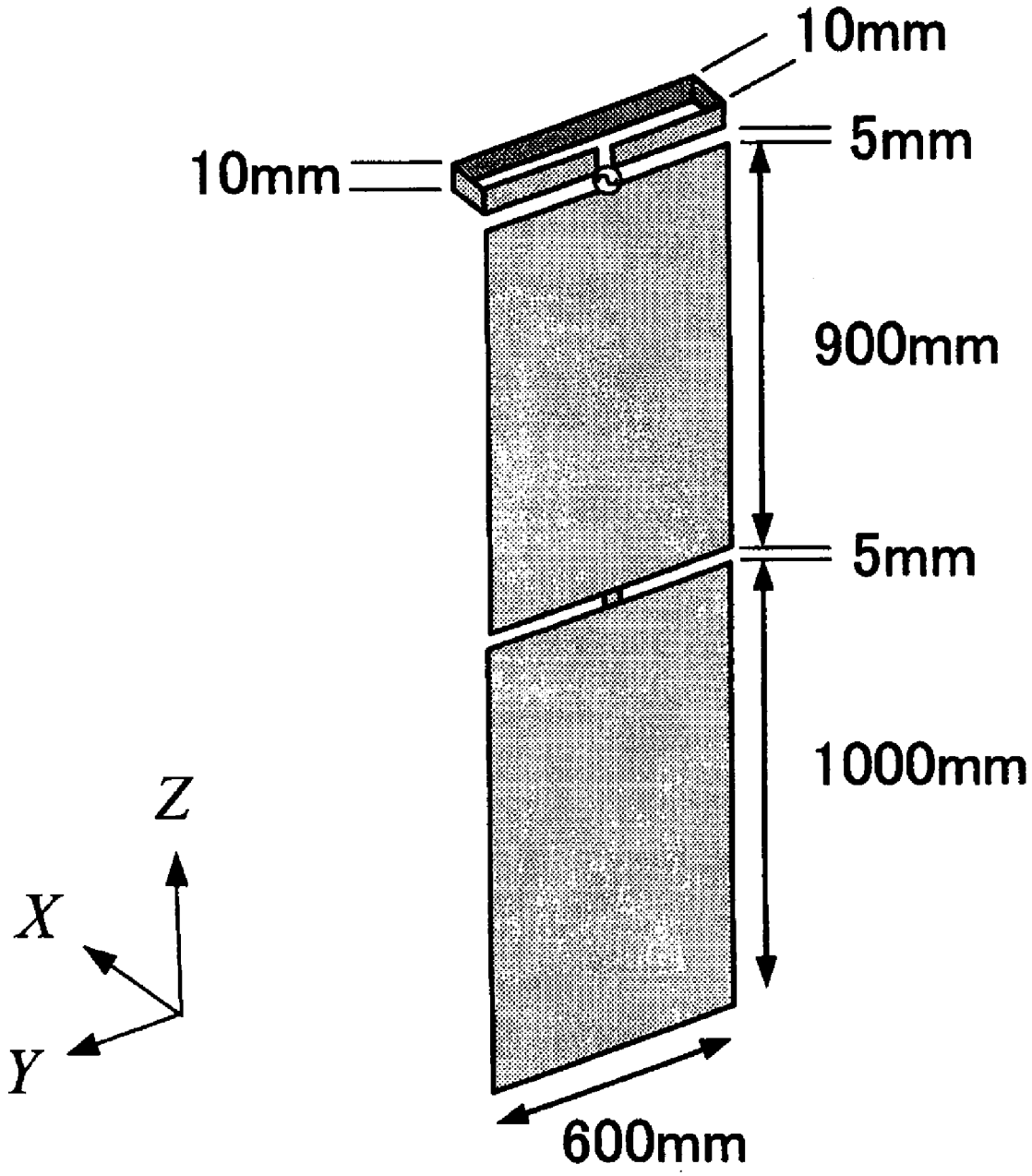
[FIG. 3] A perspective view showing a measuring model applied in the first embodiment.
Figure 4:
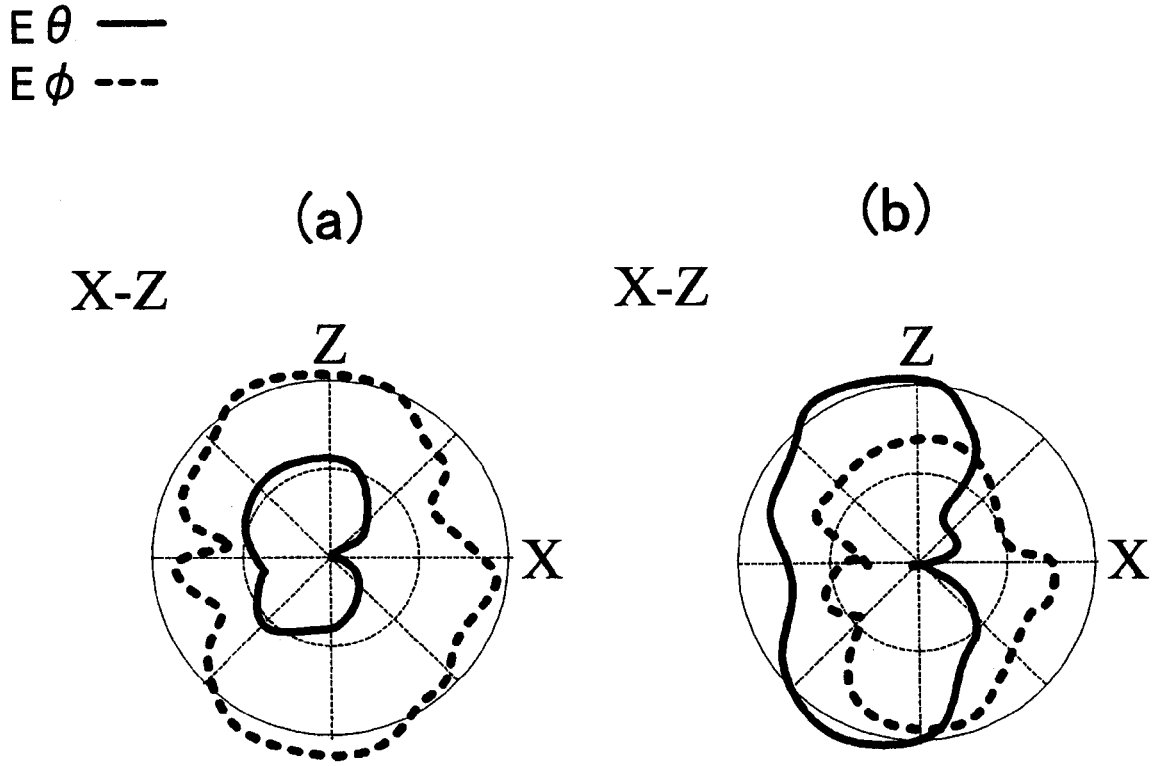
[FIG. 4] Radiation pattern charts showing the measured result obtained from the measuring model.

FIG. 1 is a block diagram showing a configuration of the antenna unit according to a first embodiment of the present invention in a state that such antenna unit is installed into a radio apparatus. FIG. 2 is radiation pattern charts showing the result of a simulation of the unit in the present embodiment. FIG. 3 is a perspective view showing a measuring model applied to the unit in the present embodiment. FIG. 4 is radiation pattern charts showing the measured result obtained from the measuring model.

The antenna unit of the present embodiment is constructed as shown in FIG. 1. It is supposed that this antenna unit is installed into a mobile receiver terminal such as a cellular phone, for example. An antenna element 2 is arranged along one side surface of a radio apparatus case 1 indicating a main body of the receiver terminal.

In this example, the radio apparatus case 1 is shaped into a rectangular prism shape, and is formed of the conductive material such as a metal. The antenna element 2 is formed like a loop by bending thin, long and narrow strip conductive material. The antenna element 2 and the radio apparatus case 1 are electrically isolated. In this case, wire conductive material may be employed as the antenna element 2.

A circuit substrate 3 and a receiver circuit 4 are provided to the inside of the radio apparatus case 1. The receiver circuit 4 is arranged on the circuit substrate 3.

One end of the antenna element 2 is connected to an input of the receiver circuit 4 as a feeding point. Also, the other end of the antenna element 2 is connected to a round (earth) of the circuit substrate 3 via a switching circuit (switch) 5.

The switching circuit 5 is a switch that can be electrically opened/closed. Actually a PIN diode or a band switching diode may be used as the switching circuit 5. The other end of the antenna element 2 is grounded when the switch of the switching circuit 5 is closed, while the other end of the antenna element 2 is opened when the switch of the switching circuit 5 is opened.

Accordingly, the antenna element 2 is connected to the receiver circuit 4 as a loop antenna when the switch of the switching circuit 5 is closed, while the antenna element 2 is connected to the receiver circuit 4 as a linear antenna whose one end is opened when the switch of the switching circuit 5 is opened. In other words, a first antenna characteristic (loop antenna) having a high sensitivity to a magnetic field and a second antenna characteristic (linear antenna) having a high sensitivity to an electric field are switched by switching the switching circuit 5.

Here, in order to get the horizontal polarization, preferably a configuration of the antenna should be set symmetrically by arranging a feeding point of the loop antenna to a center portion of the radio apparatus case 1. Also, a broader band can be obtained by shaping the antenna element 2 into a strip shape.

In the case of the loop antenna, an electrical length of one wave, for example, is selected with respect to an operating frequency to generate a horizontal polarization component. Accordingly, a length of the antenna element 2 and a loop antenna length are decided, and thus a resonance frequency of the antenna is also decided when the linear antenna is constructed. When it is supposed that the linear antenna operates as a ¼-wave monopole antenna, for example, an operating frequency used when the antenna element 2 operates as the linear antenna is ¼ of an operating frequency used when the antenna element 2 operates as the loop antenna.

That is, when the loop antenna and the linear antenna are used selectively by switching the operation mode of the antenna element 2, this antenna unit can deal with two receiving frequency bands whose frequency is largely different. Also, the loop antenna can be used as an infinitesimal loop antenna in the low frequency band such as UHF band, or the like.

A simulation was done by a computer using a simulation model prepared based on the configuration shown in FIG. 1. Examples of the resultant radiation pattern are shown in FIG. 2. As the simulation model, the case where the loop antenna whose total length is 115 mm is arranged on an upper surface of the case having a length of 100 mm, a width of 50 mm, and a height of 10 mm was assumed.

Also, simulations of the loop antenna and the linear antenna were done while changing only the feeding method respectively, and their radiation patterns were compared mutually and examined. A 2 GHz band was used as the frequency, and a length of the loop element was set to 0.93 λ (λ:wavelength).

FIG. 2(*a*) represents the radiation patterns when this antenna unit is used as the loop antenna, and FIG. 2(*b*) represents the radiation patterns when this antenna unit is used as the linear antenna. It can be confirmed from FIG. 2 that a main polarization in the case of the loop antenna (a) is a horizontal polarization component (Eϕ) and a main polarization in the case of the linear antenna (b) is a vertical polarization component (Eθ). In this case, actually a perfect loop antenna operation was not executed and a current also flows through the radio apparatus case 1. Therefore, in the case of the loop antenna, a vertical polarization component is also generated as a sub polarization.

Then, a model simulation of the actual receiving terminal was done, and characteristics of this model were evaluated. In this experiment, as shown in FIG. 3, a folding cellular phone terminal was simulated by a copper plate model likened to a perfect conductor, and the loop antenna was arranged on a top end of an upper case of this terminal. As an element length of the loop antenna, 140 mm equivalent to almost 1 λ at a measuring frequency of 2.17 GHz was used. Examples of measured results about the model were shown in FIG. 4.

FIG. 4(*a*) represents the radiation pattern when this antenna unit is used as the loop antenna, and FIG. 4(*b*) represents the radiation pattern when this antenna unit is used as the linear antenna. It can be confirmed that, when the radiation patterns in an X-Y plane are compared with each other as a representative example, the main polarization is different mutually in the horizontal polarization component (Eϕ) and the vertical polarization component (Eθ). Also, a sub polarization component appears mutually to some extent and these patterns have the frequency characteristic, nevertheless their tendencies that the main polarization is different near a predetermined frequency of 2 GHz are common.

Also, when the loop antenna is operated as the infinitesimal loop antenna that responds to the VHF band or the UHF band, the main polarization is the vertical polarization because an enclosure radiation occurs mainly. This also becomes clear from the measured result using the measuring model in FIG. 3. The different polarization can be obtained depending on the used frequency band even though the same loop antenna is used. In this case, a band of the infinitesimal loop antenna is very narrow.

Also, from the measured result of the voltage standing wave ratio (abbreviated as "VSWR" hereinafter), a resonance point can be confirmed around 550 MHz (UHF band) in the linear antenna. That is, it may be considered that the linear antenna having a total length of 140 mm operates as a ¼-λ monopole antenna. Also, a ¾-λ monopole operation can be held over the broad band at near 170 MHz, and the radio wave can be received by one antenna element in a lot of bands such as UHF band, 2 GHz or 1.7 GHz band, and the like. As a result, the antenna unit of the present embodiment can deal with the diversification of the receiving frequency.

Second Embodiment

Figure 5:
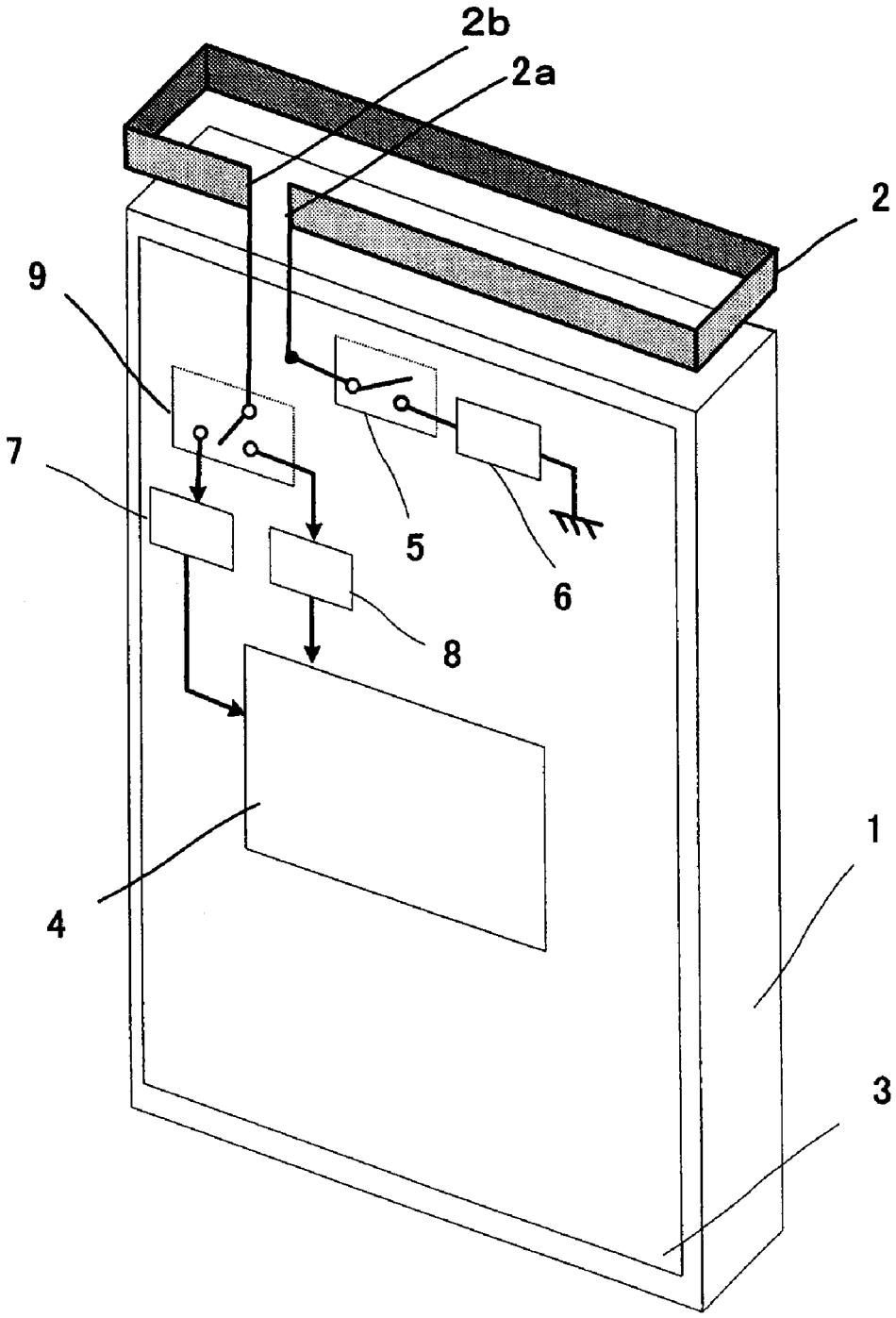
[FIG. 5] A block diagram showing a configuration of a polarization switching antenna device according to a second embodiment of the present invention in a state that such antenna unit is installed into a radio apparatus.

Another embodiment of a polarization switching antenna device of the present invention will be explained with reference to FIG. 5 hereunder. FIG. 5 is a block diagram showing a configuration of the antenna unit in this embodiment. This embodiment is a variation of the first embodiment. Also, in FIG. 5, the same reference numerals are affixed to the same elements as those in the first embodiment in the illustration.

Like the first embodiment, the loop antenna element 2 shown in FIG. 5 is arranged along the upper side surface of the radio apparatus case 1. One end 2*a* of the antenna element 2 is connected to a ground of the circuit substrate 3 via a series circuit consisting of the switching circuit 5 and a variable reactance circuit (variable reactance element) 6. The variable reactance circuit 6 is provided to adjust the receiving frequency of the antenna element 2.

The other end 2*b* of the antenna element 2 is connected to inputs of matching circuits 7, 8 via a switching circuit 9. Outputs of the matching circuits 7, 8 are connected to receiving input terminals of the receiver circuit 4 respectively. The other end 2*b* of the antenna element 2 can be connected selectively to any one of the matching circuits 7, 8 by switching the switching circuit 9.

The characteristic of the matching circuit (first matching circuit) 7 is adjusted such that the circuit is consistent with the impedance appeared when the antenna element 2 operates as the loop antenna. Also, the characteristic of the matching circuit (second matching circuit) 8 is adjusted such that the circuit is consistent with the impedance appeared when the antenna element 2 operates as the linear antenna.

Like the first embodiment, the antenna element 2 operates as the loop antenna when the switch of the switching circuit 5 is closed, while the antenna element 2 operates as the linear antenna when the switch of the switching circuit 5 is opened. Since the impedance of the antenna element 2 changes following upon the switching of the switching circuit 5, the switching circuit 9 is controlled in such a way that the switch of the switching circuit 9 operates together with the switching of the switching circuit 5. As a result, the circuit can be maintained in a matched condition in both characteristics of the loop antenna and the linear antenna.

Also, when the switch of the switching circuit 5 is closed, the variable reactance circuit 6 is connected to the antenna element 2. Thus, the receivable frequency of the antenna element 2 changes in response to the reactance of the variable reactance circuit 6. That is, the receiving frequency used when the loop antenna is constructed can be adjusted at need without change of the length of the antenna element 2.

The variable reactance circuit 6 is useful particularly when the infinitesimal loop antenna that is available in the relatively low frequency band such as the UHF band, or the like is constructed. A target available frequency can be selected by shifting a frequency in a narrow bandwidth. It may be considered that a variable capacitance element using gallium arsenide, silicon semiconductor, or the like, for example, as the variable reactance circuit 6.

In this mode, a desired matched condition can be obtained in both the case where the antenna element 2 is constructed as the loop antenna and the case where the antenna element 2 is constructed as the linear antenna. In addition, the receiving frequency of the loop antenna can be adjusted. If the receiving frequencies of two types of antenna characteristics are adjusted to the same frequency band, the polarization characteristic can be switched by switching the antenna characteristics.

Third Embodiment

Figure 6:
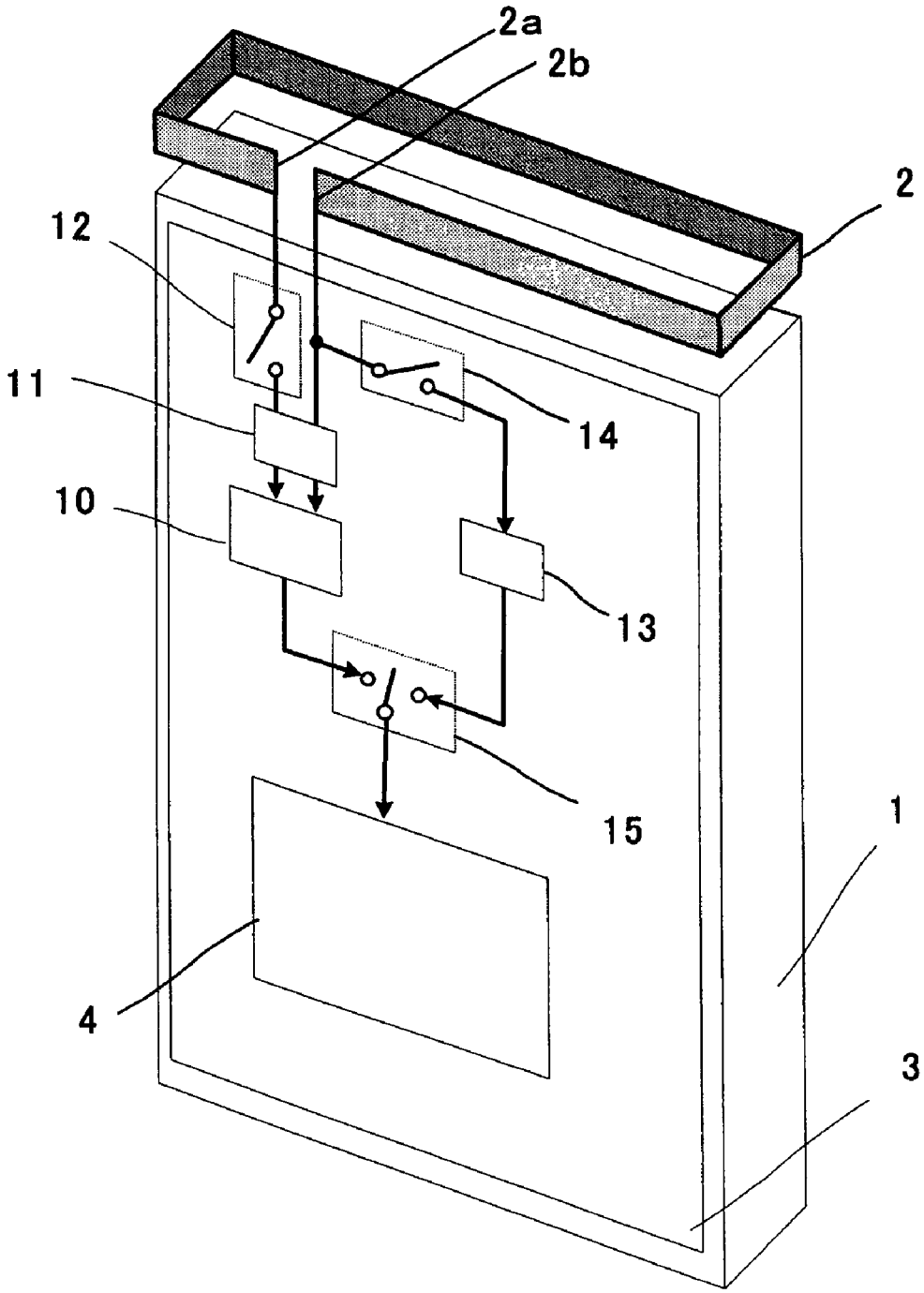
[FIG. 6] A block diagram showing a configuration of a polarization switching antenna device according to a third embodiment of the present invention in a state that such antenna unit is installed into a radio apparatus.

Still another embodiment of the polarization switching antenna device of the present invention will be explained with reference to FIG. 6 hereunder. FIG. 6 is a block diagram showing a configuration of the antenna unit in this embodiment. This embodiment is a variation of the first embodiment. Also, in FIG. 6, the same reference numerals are affixed to the same elements as those in the first embodiment in the illustration.

Like the first embodiment, the loop antenna element 2 shown in FIG. 6 is arranged along the upper side surface of the radio apparatus case 1.

In this mode, a balance/unbalance transducer circuit (balun) 10 is provided to conduct a balanced feeding of the loop antenna. Since an unbalanced feeding is applied to the linear antenna, the feeding system is different depending on which one of the loop antenna and the linear antenna is selected. The circuit shown in FIG. 6 is constructed to respond to such difference.

More particularly, one end 2*a* of the antenna element 2 is connected to one input of a matching circuit 11 via a switching circuit 12, while the other end 2*b* of the antenna element 2 is connected to the other input of the matching circuit 11. An output of the matching circuit 11 is connected to a balanced input of the balance/unbalance transducer circuit 10, and an unbalanced output of the balance/unbalance transducer circuit 10 is connected to an input of the receiver circuit 4 via a switching circuit 15.

Also, the other end 2*b* of the antenna element 2 is connected to an input of a matching circuit 13 via a switching circuit 14. Also, an output of the matching circuit 13 is connected to the input of the receiver circuit 4 via the switching circuit 15.

The switching circuit 15 inputs selectively a received signal being output from the balance/unbalance transducer circuit 10 when the antenna element 2 operates as the loop antenna and a received signal being output from the matching circuit 13 when the antenna element 2 operates as the linear antenna, into the receiver circuit 4.

In operation of this antenna unit, in case the switch of the switching circuit 12 is closed and the switch of the switching circuit 14 is opened and then the output side of the balance/unbalance transducer circuit 10 is selected by the switch of the switching circuit 15, the antenna element 2 is operated as the loop antenna and is connected to the receiver circuit 4 in terms of the balanced feeding. Also, in case the switch of the switching circuit 12 is opened and the switch of the switching circuit 14 is closed and then the output side of the matching circuit 13 is selected by the switch of the switching circuit 15, the antenna element 2 is operated as the linear antenna and is connected to the receiver circuit 4 in terms of the unbalanced feeding.

The balance/unbalance transducer circuit 10, if used, is added as a loss generated when the loop antenna is used, and also the available frequency band is restricted. In this case, a current is hard to flow toward the radio apparatus case 1 side by feeding the loop antenna in terms of the balanced feeding. As a result, the vertical polarization component radiated from the radio apparatus case 1 is reduced and the horizontal polarization is easy to get.

Actually, from the experimental result using the measuring model shown in FIG. 3, it has been confirmed that a rate of the vertical polarization component is reduced smaller. Also, the second embodiment, if the receiving frequencies of two types of antenna characteristics are adjusted to the same frequency band, the antenna unit can be used while switching the polarization characteristic in the same frequency band.

Fourth Embodiment

Figure 7:
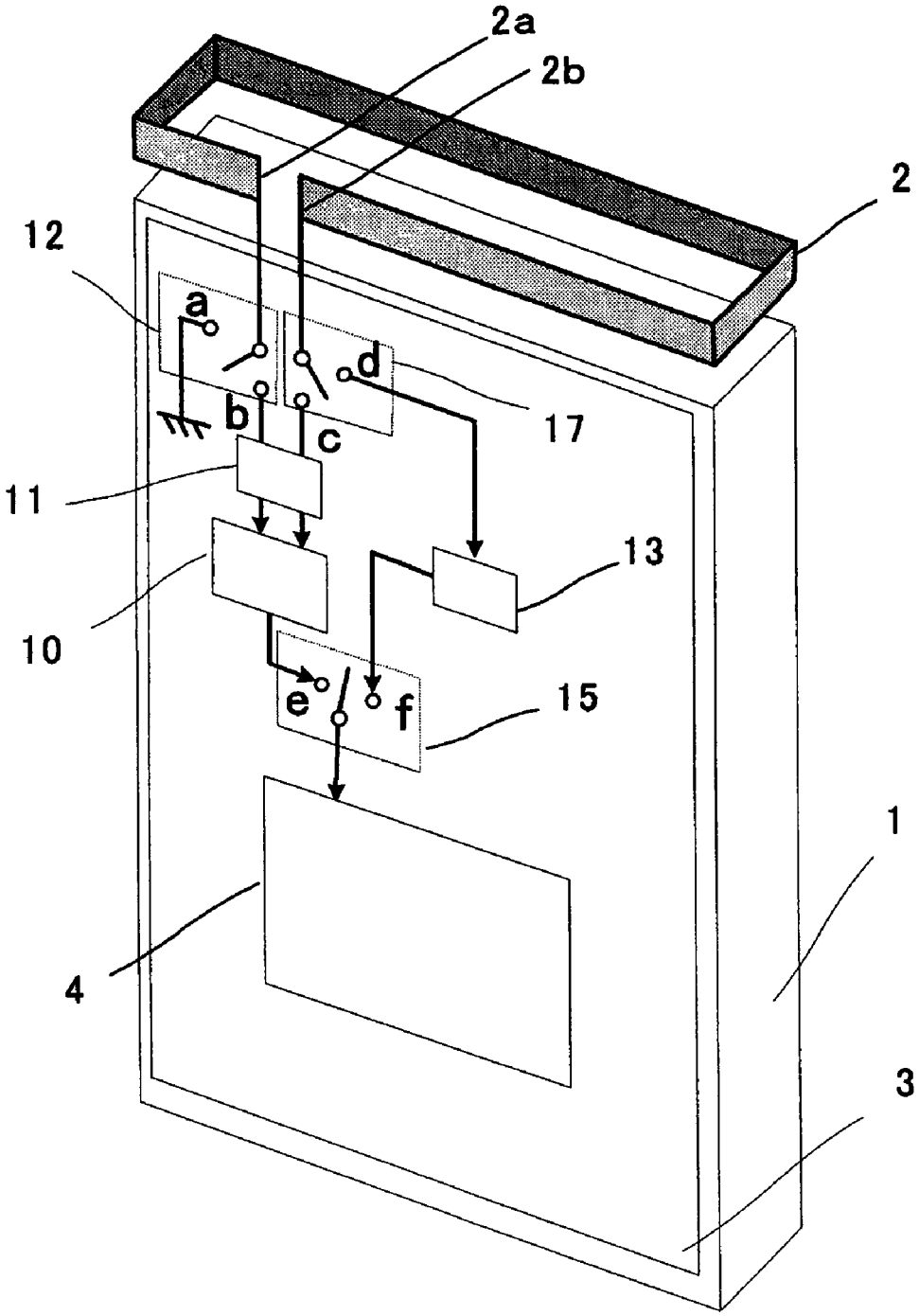
[FIG. 7] A block diagram showing a configuration of a polarization switching antenna device according to a fourth embodiment of the present invention in a state that such antenna unit is installed into a radio apparatus.

A further embodiment of the polarization switching antenna device of the present invention will be explained with reference to FIG. 7 hereunder. FIG. 7 is a block diagram showing a configuration of the antenna unit in this embodiment. This embodiment is a variation of the third embodiment. Also, in FIG. 7, the same reference numerals are affixed to the same elements as those in the third embodiment in the illustration.

Like the third embodiment, the loop antenna element 2 shown in FIG. 7 is arranged along the upper side surface of the radio apparatus case 1. Like the third embodiment, the balance/unbalance transducer circuit (balun) 10 is provided to conduct the balanced feeding of the loop antenna. However, in this mode, the antenna element 2 is used only as the loop antenna and the polarization characteristic of the antenna is switched by switching the feeding system.

As shown in FIG. 7, the switching circuit 12 is connected to one end 2*a* of the antenna element 2 and a switching circuit 17 is connected to the other end 2*b* of the antenna element 2. The switching circuits 12, 17 are provided to switch the balanced feeding and the unbalanced feeding of the loop antenna. Two switching circuits 12, 17 are switched to operate together.

The switching circuit 12 switches selectively that one end 2*a* of the antenna element 2 should be connected to either the input of the matching circuit 11 or the ground of the circuit substrate 3. The switching circuit 17 switches selectively that the other end 2*b* of the antenna element 2 should be connected to either the input of the matching circuit 11 or the input of the matching circuit 13.

In other words, in case the switch of the switching circuit 12 is connected to the b side, the switch of the switching circuit 17 is connected to the c side, and the switch of the switching circuit 15 is connected to the e side, the loop antenna of the antenna element 2 is fed in terms of the balanced feeding. In this case, the signal that the antenna element 2 received is input into the receiver circuit 4 through the switching circuits 12, 17—the matching circuit 11—the balance/unbalance transducer circuit 10—the switching circuit 15.

Also, in case the switch of the switching circuit 12 is connected to the a side, the switch of the switching circuit 17 is connected to the d side, and the switch of the switching circuit 15 is connected to the f side, the loop antenna of the antenna element 2 is fed in terms of the unbalanced feeding. In this case, the signal that the antenna element 2 received is input into the receiver circuit 4 through the switching circuits 12, 17—the matching circuit 13—the switching circuit 15.

Although such switching of the feeding system does not change the characteristics of the antenna element 2 itself, a change of the case current following through the radio apparatus case 1 appears. Consequently a difference of the polarization characteristic as the overall antenna arises.

In particular, in the case where the operating frequency of the antenna is different between the unbalanced feeding and the balanced feeding, the vertical polarization can be obtained by constructing the loop antenna in the unbalanced feeding as the infinitesimal loop antenna and also the horizontal polarization can be obtained by constructing the loop antenna in the balanced feeding as the loop antenna of almost 1 λ.

Also, even when the same frequency band is utilized in both the unbalanced feeding and the balanced feeding, the vertical polarization component appears largely depending on the frequency characteristic in the unbalanced feeding, so that this antenna unit can receive both the vertical polarization and the horizontal polarization. In other words, because the antenna characteristic is adjusted in the same frequency band in both the unbalanced feeding and the balanced feeding, this antenna unit can receive the radio wave while switching the polarization characteristic of the antenna.

Fifth Embodiment

Figure 8:
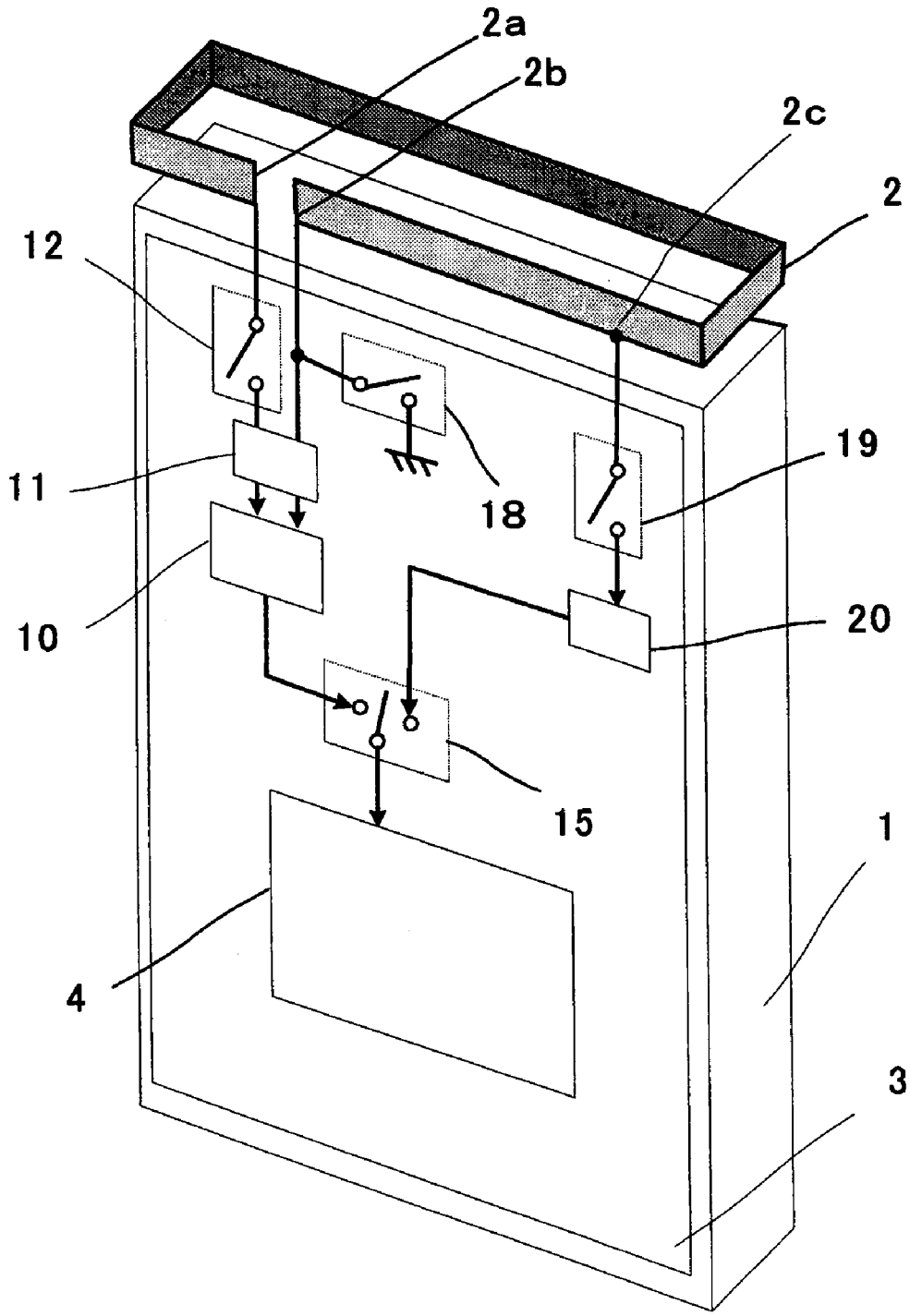
[FIG. 8] A block diagram showing a configuration of a polarization switching antenna device according to a fifth embodiment of the present invention in a state that such antenna unit is installed into a radio apparatus.

A still further embodiment of the polarization switching antenna device of the present invention will be explained with reference to FIG. 8 hereunder. FIG. 8 is a block diagram showing a configuration of the antenna unit in this embodiment. This embodiment is a variation of the third embodiment. Also, in FIG. 8, the same reference numerals are affixed to the same elements as those in the third embodiment in the illustration.

Like the third embodiment, the loop antenna element 2 shown in FIG. 8 is arranged along the upper side surface of the radio apparatus case 1. In this mode, the antenna element 2 is switched to the loop antenna and the inverted F antenna in operation.

Like the third embodiment, one end 2*a* of the antenna element 2 is connected to one input of the matching circuit 11 via the switching circuit 12, while the other end 2*b* of the antenna element 2 is connected to the other input of the matching circuit 11. The output of the matching circuit 11 is connected to the input of the balance/unbalance transducer circuit 10, and the output of the balance/unbalance transducer circuit 10 is connected to the input of the receiver circuit 4 via the switching circuit 15.

Also, a switching circuit 18 is connected to the other end 2*b* of the antenna element 2. The switching circuit 18 is a switch that selects that the other end 2*b* of the antenna element 2 should be connected to the ground of the circuit substrate 3 or should be opened.

Also, a feeding point 2*c* is provided in the middle of the antenna element 2 to constitute the inverted F antenna. The feeding point 2*c* is connected to an input of a matching circuit 20 via a switching circuit (intermediate connection switch) 19. An output of the matching circuit 20 is connected to the input of the receiver circuit 4 via the switching circuit 15.

When the antenna element 2 is utilized as the inverted F antenna, the switch of the switching circuit 12 is opened and respective switches of the switching circuit 18 and the switching circuit 19 are closed. In this case, the signal that the antenna element 2 received is input into the receiver circuit 4 through the switching circuit 19—the matching circuit 20—the switching circuit 15.

Also, when the antenna element 2 is used as the loop antenna, the switch of the switching circuit 12 is closed and respective switches of the switching circuits 18, 19 are closed. In this case, the signal that the antenna element 2 received is input into the receiver circuit 4 through the switching circuit 12—the matching circuit 11—the balance/unbalance transducer circuit 10—the switching circuit 15.

Also, when the inverted F antenna is used, a feeding location can be changed. That is, a power is fed from a portion of the switching circuit 18 to the other end 2*b* of the antenna element 2, and also the feeding point 2*c* may be grounded.

Because the inverted F antenna is constructed instead of the linear antenna, impedance matching, adjustment of a corresponding frequency, and the like can be facilitated rather than the linear antenna. Because the main polarization is the vertical polarization in the case of the inverted F antenna, the polarization can be switched by changing such antenna into the loop antenna. Namely, when both the inverted F antenna and the loop antenna are used in the same frequency band, this antenna unit can receive a radio wave while changing the polarization characteristic.

Sixth Embodiment

Figure 9:
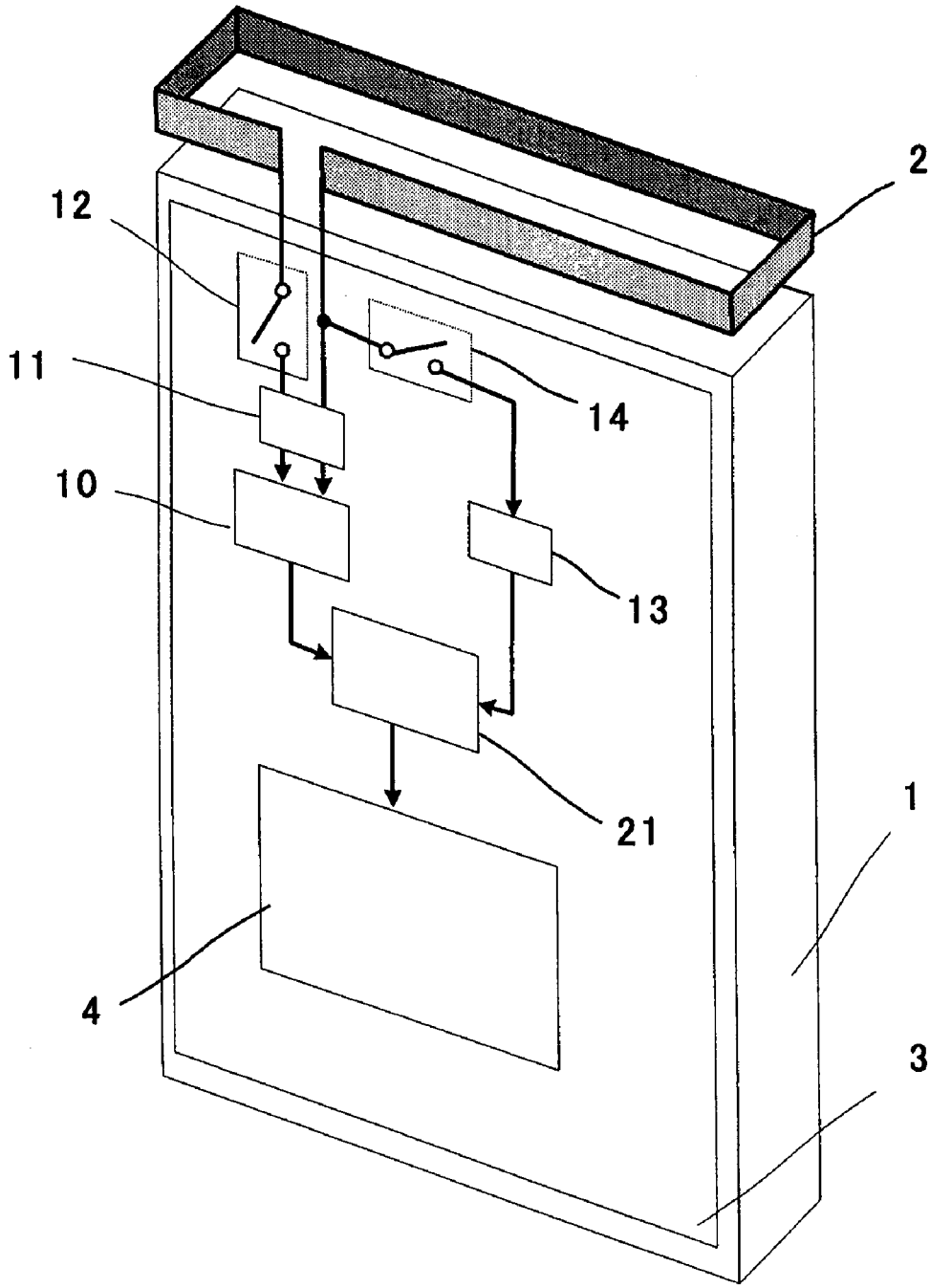
[FIG. 9] A block diagram showing a configuration of a polarization switching antenna device according to a sixth embodiment of the present invention in a state that such antenna unit is installed into a radio apparatus.

A further embodiment of the polarization switching antenna device of the present invention will be explained with reference to FIG. 9 hereunder. FIG. 9 is a block diagram showing a configuration of the antenna unit in this embodiment. This embodiment is a variation of the third embodiment. Also, in FIG. 9, the same reference numerals are affixed to the same elements as those in the third embodiment in the illustration.

Like the third embodiment, the loop antenna element 2 shown in FIG. 9 is arranged along the upper side surface of the radio apparatus case 1. In this mode, the antenna element 2 is switched to the loop antenna and the linear antenna in operation. A difference from the third embodiment is that a diversity switching circuit (diversity selecting portion) 21 is provided.

The diversity switching circuit 21 senses received electric field strengths of the received signal sensed by the loop antenna and the received signal sensed by the linear antenna respectively, and controls the received signals such that the signal having higher electric field strength is input selectively to the receiver circuit 4.

Actually, the diversity switching circuit 21 amplifies the received signal (signal of the loop antenna) that the balance/unbalance transducer circuit 10 outputs and the received signal (signal of the linear antenna) that the matching circuit 13 outputs by the low-noise amplifier respectively, measures levels of the received signals, selects the received signal having a higher level, and inputs this signal into the receiver circuit 4.

In this case, since a single antenna is used selectively as the loop antenna and the linear antenna, it is impossible to measure the received signal levels of two types of antennas at the same time. Therefore, in this mode, the diversity switching circuit 21 always grasps the received signal levels of two types of antenna characteristics respectively by switching the antenna characteristic periodically at a minute time interval to the extent a large change does not appear in a receiving sensitivity, and then switches automatically its input into the antenna characteristic having a higher receiving sensitivity. As a result, the polarization diversity can be realized by a single antenna.

In other embodiments except the third embodiment, the polarization diversity can be realized by adding the diversity switching circuit 21.

A profile of the antenna element is the loop fashion, but a deformation is made arbitrarily if the characteristic as the loop antenna can be shown. Also, it is allowed that an arrangement position of the antenna element can be changed arbitrarily. Also, arrangement positions of various circuits in the embodiments can be set arbitrarily.

With the above, various embodiments of the present invention are explained, but the present invention is not limited to the matters given in the above embodiments. Changes and adaptations made by those skilled in art based on the description of the specification and the well known technologies are acceptable to the present invention, and are contained in a scope over which protection is sought.

This application is based upon Japanese Patent Application (Patent Application No. 2004-363844) filed on Dec. 16, 2004; the contents of which are incorporated herein by reference.

INDUSTRIAL APPLICABILITY

The polarization switching antenna device of the present invention can implement plural types of antennas each having a different polarization characteristic without provision of a plurality of antenna elements. Therefore, when the present invention is applied to the case where improvement in the receiving sensitivity is needed in a wide variety of environments such as the case where an antenna installing space is limited like the mobile receiving terminal, the case where various frequency bands are needed for reception, etc., this antenna unit of the present invention is very effective.

The invention claimed is:

1. A polarization switching antenna device applied to a radio apparatus, comprising:

an antenna element that is constituted by a conductor shaped into a loop, and has a first end portion adapted to be connected to a first feeding point of the radio apparatus or a ground point and a second end portion adapted to be connected to a second feeding point of the radio apparatus or the ground point;

a switch that is provided to at least one of the first end portion and the second end portion to open the antenna element from an electronic circuit of the radio apparatus, wherein a first antenna characteristic having a high sensitivity to a magnetic field and a second antenna characteristic having a high sensitivity to an electric field are switched by switching the switch;

a Balun (Balanced to Unbalanced) that transforms a balanced input into an unbalanced output; and a route switching portion that switches a first signal route passing through the Balun and a second signal route not passing through the Balun to feed the antenna, wherein at least one of inputs of the Balun is connected to the antenna element through the switch.

2. The polarization switching antenna device according to claim 1, further comprising:

a diversity selecting portion that selects at least one of plural types of received signals which are received based on mutually different antenna characteristics, and outputs the selected signal.

3. A radio apparatus including the polarization switching antenna device set forth in claim 1.

4. A polarization switching antenna device applied to a radio apparatus, comprising:

an antenna element that is constituted by a conductor shaped into a loop, and has a first end portion adapted to be connected to a first feeding point of the radio apparatus or a ground point and a second end portion adapted to be connected to a second feeding point of the radio apparatus or the ground point;

a switch that is provided to at least one of the first end portion and the second end portion to open the antenna element from an electronic circuit of the radio apparatus, wherein a first antenna characteristic having a high sensitivity to a magnetic field and a second antenna characteristic having a high sensitivity to an electric field are switched by switching the switch; and wherein the switch is provided in double to both the first end portion and the second end portion, and both switches switch selectively a connection state so that a connection state of the antenna element is set to either of an unbalanced feeding and a balanced feeding;

a Balun that is connected to the antenna element through both switches to transform a balanced input into an unbalanced output; and a route switching portion that switches a first signal route passing through the Balun and a second signal route not passing through the Balun to feed the antenna.

5. A radio apparatus including the polarization switching antenna device set forth in claim 4.

6. The polarization switching antenna device according to claim 4, further comprising:

a diversity selecting portion that selects at least one of plural types of received signals which are received based on mutually different antenna characteristics, and outputs the selected signal.

7. A polarization switching antenna device applied to a radio apparatus, comprising:

an antenna element that is constituted by a conductor shaped into a loop, and has a first end portion adapted to be connected to a first feeding point of the radio apparatus or a ground point and a second end portion adapted to be connected to a second feeding point of the radio apparatus or the ground point;

a switch that is provided to at least one of the first end portion and the second end portion to open the antenna element from an electronic circuit of the radio apparatus, wherein a first antenna characteristic having a high sensitivity to a magnetic field and a second antenna characteristic having a high sensitivity to an electric field are switched by switching the switch; and an intermediate connection switch that is provided to an intermediate portion of the antenna element and connected to a third feeding point or a ground point, wherein the antenna element operates as an inverted F-antenna by switching the intermediate connection switch in a state that the switch is opened.

8. A radio apparatus including the polarization switching antenna device set forth in claim 7.

9. The polarization switching antenna device according to claim 7, further comprising:

a diversity selecting portion that selects at least one of plural types of received signals which are received based on mutually different antenna characteristics, and outputs the selected signal.

* * * * *